US006517219B1

(12) United States Patent
Chen

(10) Patent No.: US 6,517,219 B1
(45) Date of Patent: Feb. 11, 2003

(54) COLORFUL LAMP STRIP

(76) Inventor: Hsien-Te Chen, 2F, No. 5-1, Alley 6, Lane 502, Chungho Street, Pei Tau, Taipei (TW)

( * ) Notice: Subject to any disclaimer, the term of this patent is extended or adjusted under 35 U.S.C. 154(b) by 0 days.

(21) Appl. No.: 10/101,409

(22) Filed: Mar. 20, 2002

(51) Int. Cl.[7] ..... F21V 21/00
(52) U.S. Cl. ..... 362/349; 362/231; 362/806
(58) Field of Search ..... 362/230, 231, 362/234, 236, 237, 238, 240, 242, 249, 252, 293, 806

(56) References Cited

U.S. PATENT DOCUMENTS 4,984,142 A * 1/1991 Garnerone ..... 362/249
5,667,295 A * 9/1997 Tsui ..... 362/252
6,217,194 B1 * 4/2001 Huang ..... 362/806
6,244,726 B1 * 6/2001 Wong ..... 362/240

* cited by examiner

*Primary Examiner*—Y. My Quach Lee
(74) *Attorney, Agent, or Firm*—Rosenberg, Klein & Lee

(57) ABSTRACT

An lamp strip with a heat shrinkage tube provided with portions of different colors is disclosed. The lamp strip includes an elongate bar defining a plurality of bores spaced along the bar. A groove is defined in an outer surface of the bar and coextensive therewith. A light emitting element is received and retained in each bore. Each light emitting element has first and second wires received in and extending along the groove. The second wire of each bulb is jointed to the first wire of an adjacent bulb. The joint can be formed by simply twisting the wires together or by means of a connection element. The jointed portion of the wires is received in the corresponding cavity. The heat shrinkage tube having colorful patterns thereon or constituted by sections of different colors is fit over and encompassing the elongate bar. A light-transmitting outer tube made of plastics is then fit over the heat shrinkage tube. By means of the colorful portions of the heat shrinkage tube, the light emitted from the light emitting element is colored and display colorful light patterns to an observer.

9 Claims, 5 Drawing Sheets

COLORFUL LAMP STRIP

BACKGROUND OF THE INVENTION

1. Field of the Invention

The present invention relates generally to a lamp strip, and in particular to a lamp strip with a heat shrinkage tube provided with portions of different colors.

2. Description of the Prior Art

Lamp strips for decorative purposes are known. Examples include U.S. Pat. No. 6,244,726 B1 wherein a lamp strip comprising an elongate bar retaining a number of light bulbs and a transparent covering completely surrounding the bar and the light bulbs is disclosed. Since the covering functions for protection and water resistance, it provides no decorative purposes. Color of the light emitted from the bulbs cannot be changed unless the bulbs are changed.

It is thus desired to provide a lamp strip that gives off colorful light for consumer appealing.

SUMMARY OF THE INVENTION

An object of the present invention is thus to provide a lamp strip which gives off colorful light.

Another object of the present invention is to provide a lamp strip which is consumer appealing.

A further object of the present invention is to provide a lamp strip having excellent protection and water resistance.

To achieve the above objects, in accordance with the present invention, there is provided a lamp strip comprising an elongate bar defining a number of bores spaced along the bar. A cavity is defined in the bar between adjacent bores. A groove is defined in an outer surface of the bar and coextensive therewith. A light bulb or other light emitting element is received and retained in each bore. Each bulb has first and second wires received in and extending along the groove. The second wire of each bulb is jointed to the first wire of an adjacent bulb. The joint can be formed by simply twisting the wires together or by means of a connection element. The jointed portion of the wires is received in the corresponding cavity. A heat shrinkage tube having colorful patterns formed thereon or constituted by sections of different colors is tightly fit over and encompassing the elongate bar. A light-transmitting, outer tube made of plastics is then fit over the heat shrinkage tube. By means of the colorful portions of the heat shrinkage tube, the light emitted from the light emitting element is colored and display colorful light patterns to an observer.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
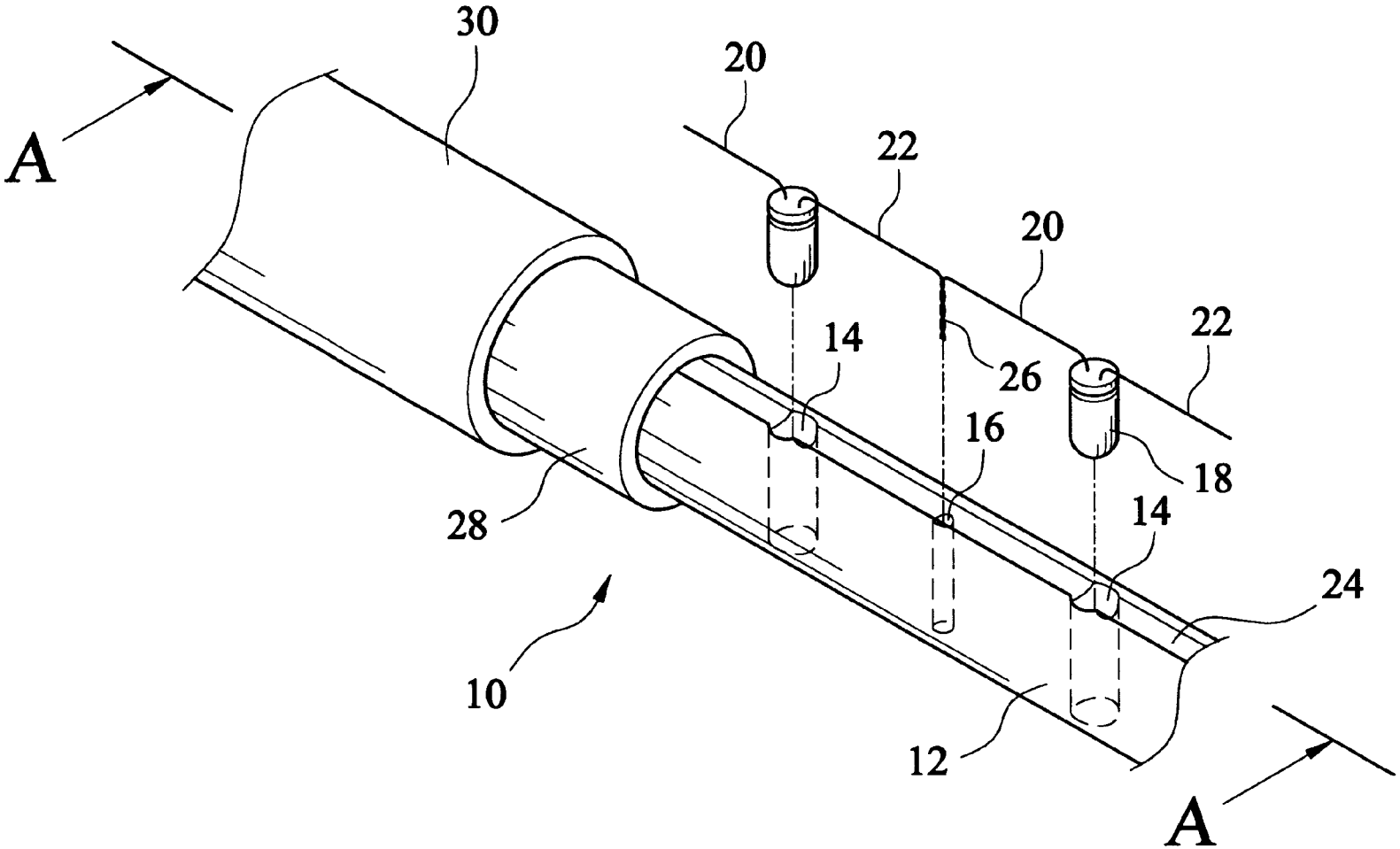
FIG. 1 is a perspective view of a lamp strip constructed in accordance with the present invention.
Figure 2:
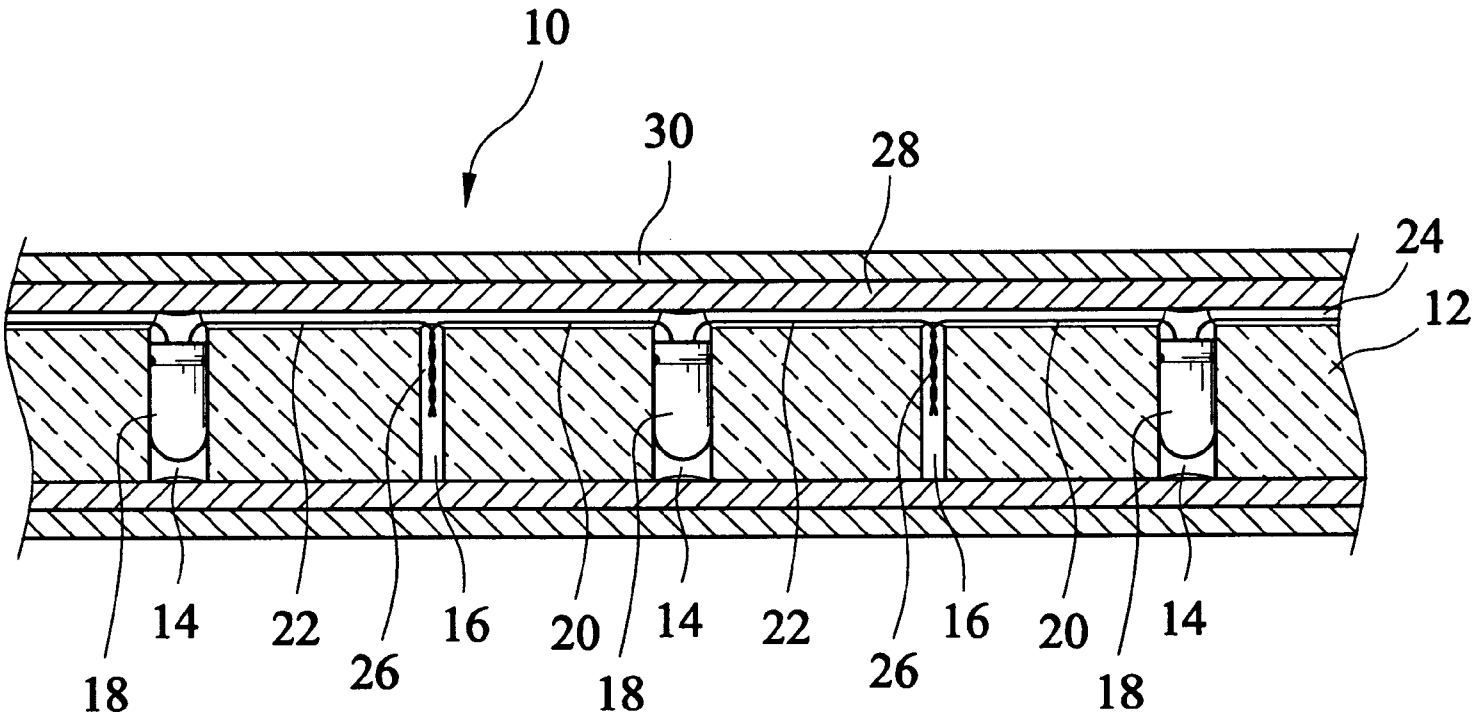
FIG. 2 is a cross-sectional view of the lamp strip of the present invention, taken along line A—A of FIG. 1.

With reference to the drawings and in particular to FIGS. 1 and 2, a lamp strip constructed in accordance with the present invention, generally designated with reference numeral 10, comprises an elongate bar 12 defining a number of bores 14 spaced along the bar 12. A cavity 16 is defined in the bar 12 between adjacent bores 14. A light emitting element 18, such as a light bulb, is received and retained in each bore 14. Each light emitting element 18 has first and second wires 20, 22.

A groove 24 is defined in an outer surface (not labeled) of the bar 12 and substantially coextensive therewith. The groove 24 is in communication with the bores 14 and the cavities 16. The wires 20, 22 of the light emitting elements 18 are received in and extending along the groove 24. The second wire 22 of each light emitting element 18 and the first wire 20 of an adjacent one of the light emitting elements 18 are jointed together at 26. The joint 26 can be done by simply twisting the wires 20, 22 together. Alternatively, a connection element may be used to connect and fix the wires 20, 22 together. The joint 26 is received in the cavity 16 located between the bores 14 of the two light emitting elements 18. A power source (not shown) supplies electricity to all the light emitting elements 18 through the wires 20, 22 and the joints 26 therebetween.

A heat shrinkage tube 28 in the form of an elongate light-transmitting inner tube is fit over the bar 12 and securely retains the light emitting elements 18 and the wires 20, 22 in position inside the bar 12. Preferably, the heat-shrinkage tube 28 is made of a light-transmitting, heat-shrinkage material. An outer tube 30, preferably made of plastics, is tightly fit over the heat shrinkage tube 28 for protection and water resistance. The outer tube 30 is made of a light-transmitting material. Light emitting from the light emitting elements 18 are projected through the heat shrinkage tube 28 and the outer tube 30.

The heat shrinkage tube 28 that surrounds the bar 12 serves to protect the bar 12 and the light emitting elements 18 from damage and humidity. Thus, with the bar 12 surrounded by both the heat shrinkage tube 28 and the outer tube 30, an excellent protection of the bar 12 and the light emitting elements 18 can be obtained.

Figure 3:
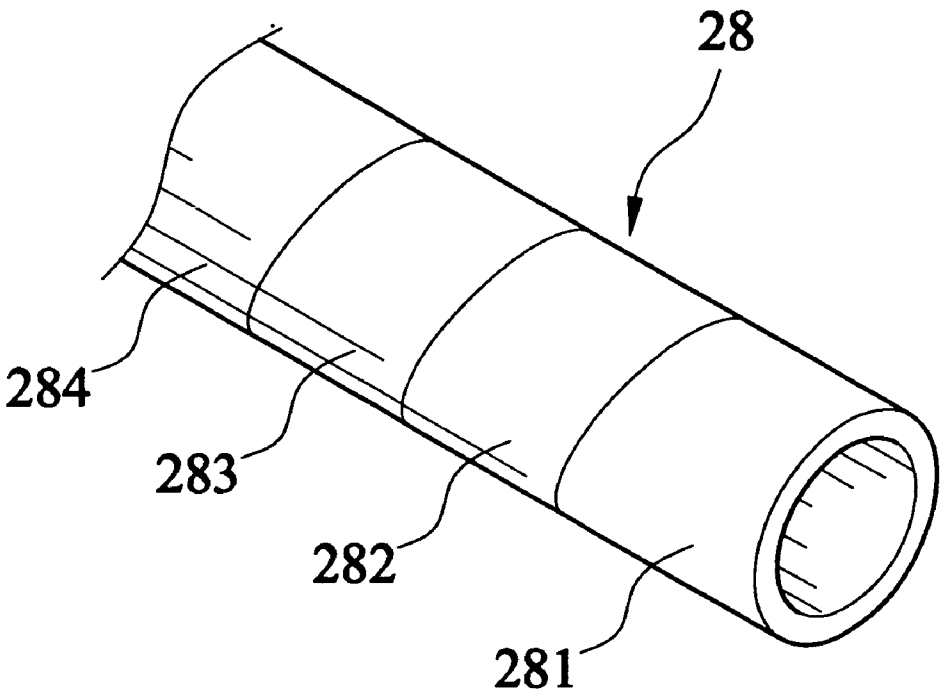
FIG. 3 is a perspective view of a heat shrinkage tube of the lamp strip in accordance with a first embodiment of the present invention.

Besides protection of the bar 12 and the light emitting elements 18, the heat shrinkage tube 28 also provides other functions. FIG. 3 shows a first embodiment of the heat shrinkage tube 28 in accordance with the present invention. The heat shrinkage tube 28 shown in FIG. 3 comprises a number of ring-like sections 281~284 arranged along the length of the heat shrinkage tube 28. The sections 281~284 are selectively provided with different colors whereby light from a single light source transmitting through the sections 281~284 becomes light of different colors.

Figure 4:
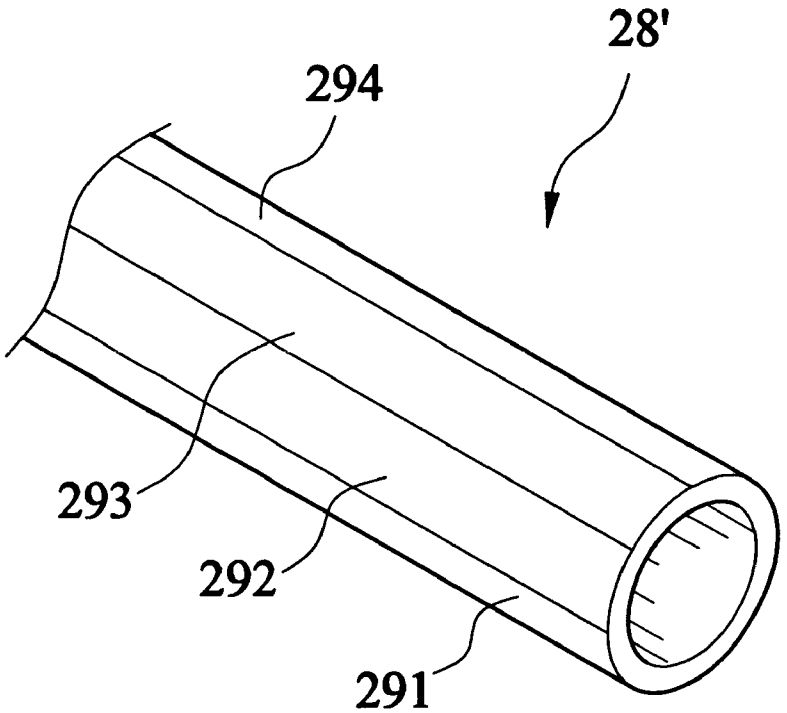
FIG. 4 is a perspective view of a heat shrinkage tube of the lamp strip in accordance with a second embodiment of the present invention.

FIG. 4 shows a second embodiment of the heat shrinkage tube in accordance with the present invention which is designated with reference numeral 28' for distinction. The heat shrinkage tube 28' is comprised of a number of longitudinally extending strips 291~294 that are of different colors whereby light from a single light source transmitting through the strips 291~294 becomes light of different colors.

Figure 5:
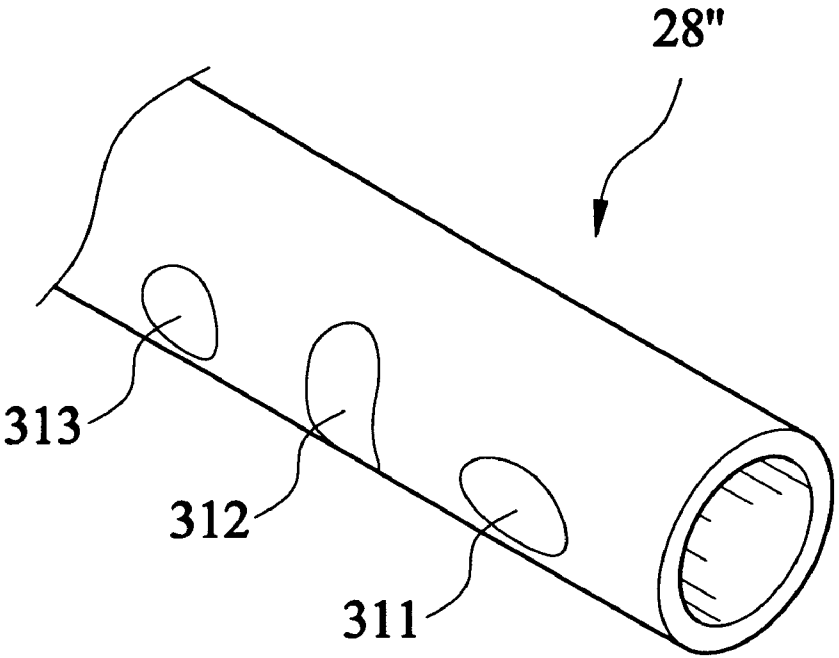
FIG. 5 is a perspective view of a heat shrinkage tube of the lamp strip in accordance with a third embodiment of the present invention.

FIG. 5 shows a third embodiment of the heat shrinkage tube in accordance with the present invention which is designated with reference numeral 28" for distinction. The heat shrinkage tube 28" forms patterns of different colors thereon. The patterns comprise spots 311~313 of different sizes and colors whereby light from a single light source transmitting through the spots 311~313 becomes light of different colors. It is apparent to those having ordinary skills to form any desired patterns of any shapes, sizes and colors on the heat shrinkage tube.

Although the present invention has been described with reference to the preferred embodiments thereof, it is apparent to those skilled in the art that a variety of modifications and changes may be made without departing from the scope of the present invention which is intended to be defined by the appended claims. For example, the heat shrinkage tube 28 can be integrally formed with the outer tube 30 for reducing the number of the parts.

What is claimed is:

1. A lamp strip comprising:

an elongate bar defining a plurality of bores spaced along the bar;

a plurality of light emitting elements, each of which being received in the bore arranged on the elongate bar for emitting light;

a light-transmitting inner layer fit over and surrounding the elongate bar, the inner layer including portions of different colors; and a light-transmitting outer layer tightly fit over and surrounding the inner layer.

2. The lamp strip as claimed in claim 1, wherein the light-transmitting inner layer is a heat shrinkage tube.

3. The lamp strip as claimed in claim 1, wherein said portions of different colors comprise a plurality of ring-like sections of different colors arranged along the length of the light-transmitting inner layer.

4. The lamp strip as claimed in claim 1, wherein said portions of different colors comprise a plurality of longitudinal strips of different colors extending along the length of the light-transmitting inner layer.

5. The lamp strip as claimed in claim 1, wherein said portions of different colors comprise patterns of different colors formed on the inner layer.

6. The lamp strip as claimed in claim 1, wherein the elongate bar has an outer surface in which a groove is defined along the length of the elongate bar and wherein each light emitting element having a first wire and a second wire received in the groove and partially extending along the groove.

7. The lamp strip as claimed in claim 6, wherein the second wire of each light emitting element is jointed to the first wire of an adjacent one of the light emitting elements.

8. The lamp strip as claimed in claim 7, wherein a cavity is defined in the bar for receiving the joint of the wires therein.

9. The lamp strip as claimed in claim 1, wherein the light emitting element comprises a light bulb.

* * * * *